US005344734A

United States Patent [19]

Monbaliu et al.

[11] Patent Number: 5,344,734

[45] Date of Patent: Sep. 6, 1994

[54] ELECTROPHOTOGRAPHIC RECORDING MATERIAL

[75] Inventors: Marcel J. Monbaliu, Mortsel; David R. Terrell, Lint; Stefaan K. De Meutter, Antwerpen, all of Belgium

[73] Assignee: AGFA-Gevaert, N.V., Mortsel, Belgium

[21] Appl. No.: 935,293

[22] Filed: Aug. 26, 1992

[30] Foreign Application Priority Data

Sep. 24, 1991 [EP] European Pat. Off. ..... 91202472.6

[51] Int. Cl.[5] ..... G03G 5/047; G03G 5/06

[52] U.S. Cl. ..... 430/59; 430/73; 430/50; 430/75

[58] Field of Search ..... 430/57, 58, 59, 70, 430/71, 73, 74, 96, 135, 75, 56

[56] References Cited

U.S. PATENT DOCUMENTS

| | | | |
|---|---|---|---|
| 5,055,366 | 10/1991 | Yu et al. | 430/66 |
| 5,128,228 | 7/1992 | Ueda et al. | 430/59 |
| 5,202,207 | 4/1993 | Kanemaru et al. | 430/76 |
| 5,219,692 | 6/1993 | Shimada et al. | 430/58 |
| 5,262,261 | 11/1993 | Kikuchi et al. | 430/59 |

FOREIGN PATENT DOCUMENTS

| | | | |
|---|---|---|---|
| 3182762 | 8/1991 | Japan | 430/74 |

*Primary Examiner*—Christopher D. Rodee
*Attorney, Agent, or Firm*—Breiner & Breiner

[57] ABSTRACT

An electrophotographic recording material which comprises an electrically conductive support having thereon a photoconductive layer containing at least one aromatic amino compound having positive charge transport capacity, wherein said aromatic amino compound is within the scope of general formula (A) defined in the description.

9 Claims, No Drawings

ELECTROPHOTOGRAPHIC RECORDING MATERIAL

DESCRIPTION

1. Field of the Invention

The present invention relates to a photosensitive recording material suited for use in electrophotography.

2. Background of the invention

In electrophotography photoconductive materials are used to form a latent electrostatic charge image that is developable with finely divided colouring material, called toner.

The developed image can then be permanently affixed to the photoconductive recording material, e.g. photoconductive zinc oxide-binder layer, or transferred from the photoconductor layer, e.g. selenium layer, onto a receptor material, e.g. plain paper and fixed thereon. In electrophotographic copying and printing systems with toner transfer to a receptor material the photoconductive recording material is reusable. In order to permit a rapid multiple printing or copying a photoconductor layer has to be used that rapidly looses its charge on photo-exposure and also rapidly regains its insulating state after the exposure to receive again a sufficiently high electrostatic charge for a next image formation. The failure of a material to return completely to its relatively insulating state prior to succeeding charging/imaging steps is commonly known in the art as "fatigue".

The fatigue phenomenon has been used as a guide in the selection of commercially useful photoconductive materials, since the fatigue of the photoconductive layer limits the copying rates achievable.

Another important property which determines whether or not a particular photoconductive material is suited for electrophotographic copying is its photosensitivity that must be high enough for use in copying apparatus operating with a copying light source of fairly low intensity.

Commercial usefulness further requires that the photoconductive layer has a chromatic sensitivity that matches the wavelength(s) of the light of the light source, e.g., laser or has panchromatic sensitivity when white light is used e.g. to allow the reproduction of all colours in balance.

Intensive efforts have been made to satisfy said requirements, e.g. the spectral sensitivity of selenium has been extended to the longer wavelengths of the visible spectrum by making alloys of selenium, tellurium and arsenic, In fact selenium-based photoconductors remained for a long time the only really useful photoconductors although many organic photoconductors were discovered.

Organic photoconductor layers of which poly(N-vinylcarbazole) layers have been the most useful were less interesting because of lack of speed, insufficient spectral sensitivity and rather large fatigue.

However, the discovery that 2,4,7-trinitro-9-fluorenone (TNF) in poly(N-vinylcarbazole) (PVCz) formed a charge-transfer complex strongly improving the photosensitivity (ref. U.S. Pat. No. 3,484,237) has opened the way for the use of organic photoconductors in copying machines that could compete with the selenium-based machines.

TNF acts as an electron acceptor whereas PVCz serves as electron donor. Films consisting of said charge transfer complex with TNF:PVCz in 1:1 molar ratio are dark brown, nearly black and exhibit high charge acceptance and low dark decay rates. Overall photosensitivity is comparable to that of amorphous selenium (ref. Schaffert, R. M. IBM J. Res. Develop., 15, 75 (1971). A further search led to the discovery of phthalocyanine-binder layers, using poly(N-vinylcarbazole) as the binder [ref. Hackett, C. F., J. Chem. Phys., 55, 3178 (1971)]. The phthalocyanine was used in the metal-free X form and according to one embodiment applied in a multilayer structure wherein a thin layer of said phthalocyanine was overcoated with a PVCz layer. Hackett found that photoconductivity was due to field dependent photogeneration of electron-hole pairs in the phthalocyanine and hole injection into the PVCz. The transport of the positive charges, i.e. positive hole conduction proceeded easily in the PVCz layer. From that time on much research has been devoted to developing improved photoconductive systems wherein charge generation and charge transport materials are separate in two contiguous layers (see e.g. U.K. Pat No. 1,577,859). The charge generating layer may be applied underneath or on top of the charge transport layer. For practical reasons, such as less sensitivity to wear and ease of manufacture, the first mentioned arrangement is preferred wherein the charge generating layer is sandwiched between a conductive support and a light transparent charge transport layer (ref. Wolfgang Wiedemann, Organische Photoleiter—Ein Uberblick, II, Chemiker Zeitung, 106. (1982) Nr. 9 p. 315).

In order to form a photoconductive two layer-system with high photosensitivity to the visible light dyes having the property of photo-induced charge generation have been selected. Preference is given to a water-insoluble pigment dye of e.g. one of the following classes:

a) perylimides, e.g.C.I. 71 130 (C.I. -Colour Index) described in DBP 2 237 539, b) polynuclear quinones, e.g. anthanthrones such as C.I. 59 300 described in DBP 2 237 678, c) quinacridones, e.g.C.I. 46 500 described in DBP 2 237 679, d) naphthalene 1,4,5,8-tetracarboxylic acid derived pigments including the perinones, e.g. Orange GR, C.I. 71 105 described in DBP 2 239 923, e) phthal ocyanines and naphthal ocyani nes, e.g. $H_2$-phthal ocyanine in X-crystal form (X-$H_2$Pc), metal phthalocyanines, e.g. CuPc C.I. 74 160 described in DBP 2 239 924, indium phthalocyanine described in U.S. Pat. No. 4,713,312, and silicon naphthalocyanines having siloxy groups bonded to the central silicon as described in EP-A 0 243 205.

f) indigo- and thioindigodyes, e.g. Pigment Red 88, C. I. 73 312 described in DBP 2 237 680, g) benzothioxanthene-derivatives as described e.g. in DAS 2 355 075, h) perylene 3,4,9,10-tetracarboxylic acid derived pigments including condensation products with o-diamines as described e.g. in DAS 2 314 051, i)polyazo-pigments including bisazo-, trisazo- and tetrakisazo-pigments, e.g. Chlordiane Blue C.I. 21 180 described in DAS 2 635 887, and bisazopigments described in DOS 2 919 791, DOS 3 026 653 and DOS 3 032 117, j) squarilium dyes as described e.g. in DAS 2 401 220, k) polymethine dyes.

l) dyes containing quinazoline groups, e.g. as described in GB-P 1 416 602 according to the following general formula:

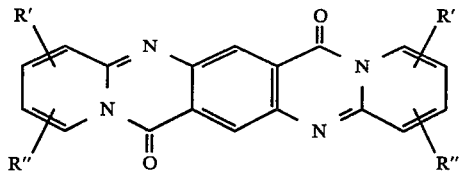

in which R′ and R″ are either identical or different and denote hydrogen, $C_1$–$C_4$ alkyl, alkoxy, halogen, nitro or hydroxyl or together denote a fused aromatic ring system, m) triarylmethane dyes, and n) dyes containing 1,5 diamino-anthraquinone groups.

The charge transporting layer can comprise either a polymeric material or a nonpolymeric material. In the case of nonpolymeric materials the use of such materials with a polymeric binder is generally preferred or required for sufficient mechanical firmness and flexibility. This binder may be "electronically inert" (that is incapable Of substantial transport of at least one species of charge carrier) or can be "electronically active" (capable of transport of that species of charge carriers that are neutralized by a uniformly applied electrostatic charge). For example, in the arrangement: conductive support—charge generating layer—charge transport layer, the polarity of electrostatic charging that gives the highest photosensitivity to the arrangement has to be such that negative charging is applied to a hole conducting (p-type) charge transport layer and positive charging is applied to an electron conducting (n-type) charge transport layer.

Since most of the organic pigment dyes of the charge generating layer provide more efficient hole injection than electron injection across a field-lowered barrier at the interface where pigment-dye/charge transport compounds touch each other and possibly form a charge transfer complex there is a need for charge transport materials that have a good positive hole transport capacity for providing an electrophotographic recording system with low fatigue and high photosensitivity.

According to the already mentioned article "Organische Photoleiter—Ein Uberblick; II of Wolfgang Wiedemann, p. 321, particularly efficient p-type transport compounds can be found in the group consisting of heteroaromatic compounds, hydrazone compounds and triphenylmethane derivatives.

Numerous prior art patents deal with hole transporting CTM's (p-CTM's) but none of them satisfy an ideal mix of characteristics such as:

high (>10 g/100 ml) solubility in the casting solvent;

solubility in the chosen binder at a concentration of at least 50% by weight of p-CTM;

sufficiently low plasticization of the chosen binder so that a layer with 50 % by weight of p-CTM still has a glass transition temperature (Tg) of at least 70 ° C.;

high charge acceptance capability;

high positive charge carrier (hole) transport capacity;

acceptable fatigue during cycling;

no significant absorption of visible light;

producible without recourse to carcinogenic raw materials, intermediates or reagents;

be itself non-carcinogenic;

be chemically stable;

be easily producible in good yield from readily available inexpensive raw materials.

3. Objects and summary of the invention

It is an object of the present invention to provide an electrophotographic recording material comprising a conductive substrate and a photosensitive layer containing an organic photoconductor compound that has a high p-type charge transport capacity.

It is a further object of the present invention to provide an electrophotographic composite layer material comprising on a conductive support a charge generating layer in contiguous relationship with a charge transporting layer containing an aromatic amino compound having a high p-type charge transport capacity.

It is another object of the present invention to provide an electrophotographic recording material containing a photoconductive binder layer incorporating an aromatic amino compound having high a p-type charge capacity with good abrasion resistance and good chargeability.

It is still another object of the present invention to provide a recording process wherein a charge pattern of negative charge polarity is formed on said composite layer material by negatively charging the charge transport layer containing a particular photoconductive aromatic amino compound and imagewise photo-exposing the charge generating layer that is in contiguous relationship with said charge transporting layer.

It is a further object of the present invention to provide electrophotographic recording materials with high photosensitivity which after being charged obtain a very sharp decrease in voltage [ΔV] within a particular narrow range [ΔE] of photo-exposure doses, wherein the photo-exposure doses required for 10 % and 90% discharge differ by a factor of 4.5 or less.

Other objects and advantages of the present invention will appear from the further description and examples.

In accordance with the present invention an electrophotographic recording material is provided which comprises an electrically conductive support having thereon a photoconductive layer, containing at least one aromatic amino compound having positive charge transport capacity (p-CTM compound), characterized in that said compound corresponds to the following general formula (A):

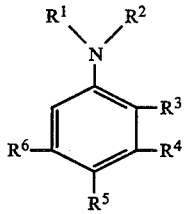

wherein: each of $R^1$ and $R^2$ (same or different) represents an unsubstituted or substituted aryl group, e.g. an alkaryl group or a heterocyclic group; each of $R^3$ and $R^5$ (same or different) represents hydrogen, an alkyl group, an aralkyl group, halogen or an aryl group, and each of $R^4$ and $R^6$ (same or different) represents an aryl or a heterocyclic group including said groups in substituted form.

According to a particularly interesting embodiment of the present invention an electrophotographic recording material is provided which comprises an electrically conductive support having thereon a charge generating layer in continuous relationship with a charge transporting layer, characterized in that said charge transporting layer contains an aromatic amino compound within the scope of said general formula (A) as defined above.

4. Detailed Description of the Invention

In preferred compounds for use according to the present invention each of $R^1$ and $R^2$ independently represents an aryl group, each of $R^3$ and $R^5$independently represents hydrogen or an alkyl group, and each of $R^4$ and $R^6$ independently represents an aryl group or a heterocyclic group such as a thienyl group.

Aromatic amino compounds with melting point of at least 100 ° C. are preferred in order to prevent softening of the charge transporting layer and diffusion of said compound out of the recording material at elevated temperature. Specific examples of aromatic amino compounds suited for use according to the present invention are listed in the following Table 1, wherein also non-invention compounds 7, 8 and 9 are mentioned for comparative test purposes with regard to dischargeability.

TABLE 1

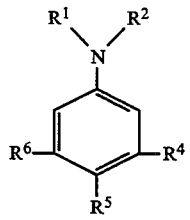

| No. | $R^1$ | $R^2$ | $R^4$ | $R^5$ | $R^6$ | melting point °C. | $E_{ox}^{\frac{1}{2}}$ | solubility in $CH_2Cl_2$ g/100 ml |
|---|---|---|---|---|---|---|---|---|
| 1 | 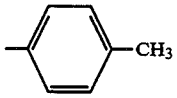 | 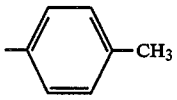 | 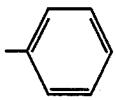 | H | 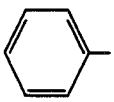 | 170 | 0.900 | 30 |
| 2 | 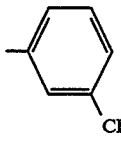 | 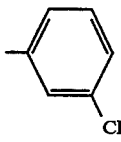 | 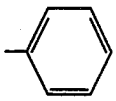 | H | 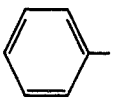 | 178 | 0.980 | 20 |
| 3 | 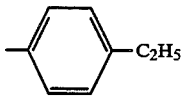 | 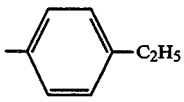 | 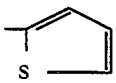 | H | 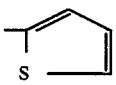 | 122 | 0.920 | >25 |
| | | | $R^5$ = H $R^4$ and $R^6$ are the same: | | | | | |
| 4 | 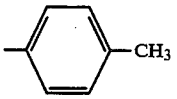 | 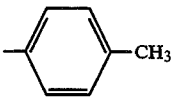 | 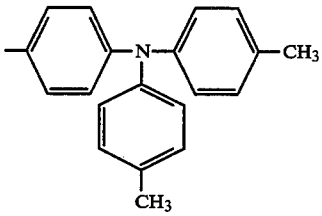 | | | — | — | — |
| 5 | 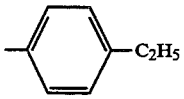 | 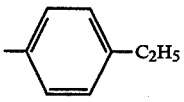 | 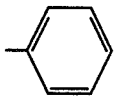 | H | 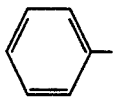 | 151 | — | 10 |
| 6 | 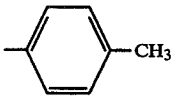 | 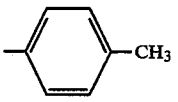 | 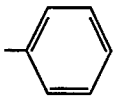 | $CH_3$ | 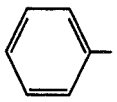 | 172 | — | 50 |
| 7 | 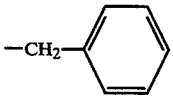 | 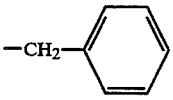 | 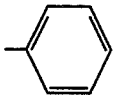 | H | 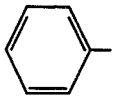 | 134 | 1.000 | 25 |

TABLE 1-continued

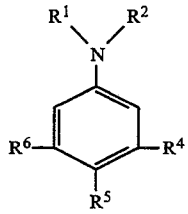

| No. | $R^1$ | $R^2$ | $R^4$ | $R^5$ | $R^6$ | melting point °C. | $E_{ox}^{\frac{1}{2}}$ | solubility in $CH_2Cl_2$ g/100 ml |
|---|---|---|---|---|---|---|---|---|
| 8 | 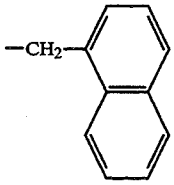 | 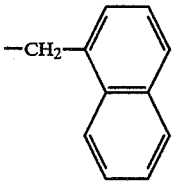 | 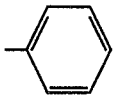 | H | 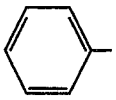 | 174 | 1.030 | 25 |
| 9 | 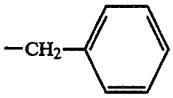 | 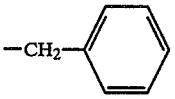 | 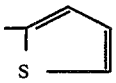 | H | 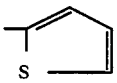 | 145 | 1.045 | 20 |

Anilino compounds suited for use in the preparation of compounds according to the above general formula (A) can be prepared according to the following reaction scheme:

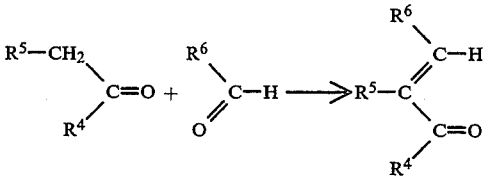

-continued

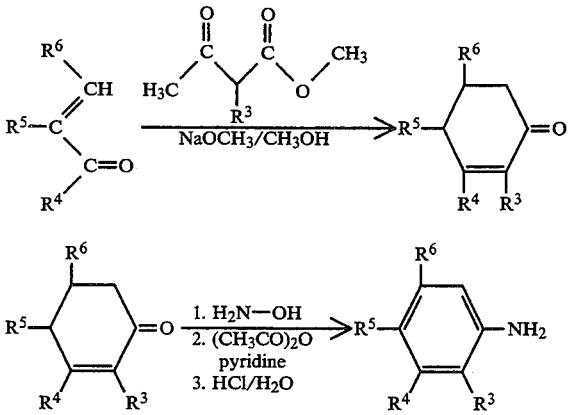

For illustrative purposes follows a detailed description of the preparation of compound No. 5 of Table 1.

Preparation of compound No. 5

Reaction scheme:

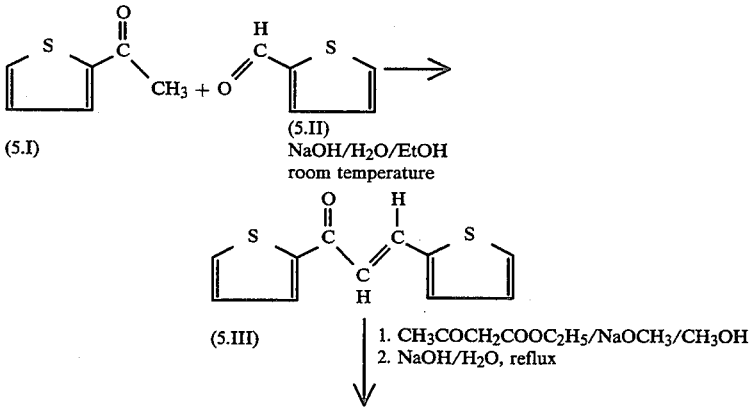

-continued

Reaction scheme:

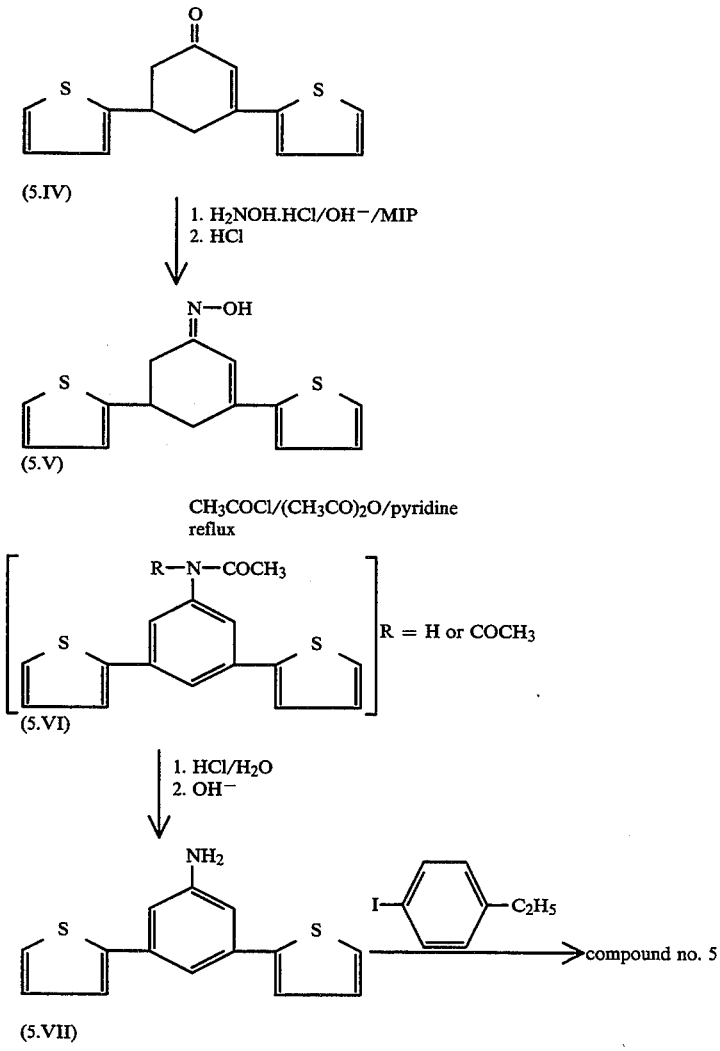

Preparation of compound (5.III)

50 g (1.25 mol) of sodium hydroxide were dissolved in 500 ml of water and 250 ml of ethanol. To solution obtained was cooled down to about 10° C. and 108 ml (1 mol) of 2-acetyl-thiophene and 87.5 ml (1 mol) of 2-formylthiophene were added. The reaction temperature rose to room temperature. At that temperature the reaction mixture was stirred for 6 h and the precipitate formed in the reaction was separated by filtration.

The solid product was washed with water until neutral and dried.

Yield: 208 g (94 %); Melting point: 98 ° C.

Preparation of compound (5. IV)

112 g (0.95 mol) of acetylacetic acid ethylester were added to 148 ml of 30% wt. sodium methylate in methanol. To the solution obtained a warm solution of 177 g (0.8 mol) of compound (5.III) in 560 ml of methanol were added. The reaction mixture was refluxed for 4 h, after which 240 ml of 10N sodium hydroxide were added and reflux continued for 2 h. The reaction mixture was cooled down and the precipitate formed was separated by filtration. The precipitate was stirred in boiling water and after cooling the mixture, the precipitate was again separated by filtration. After drying, 191 g (Yield 91%) of compound (5.IV) was obtained. Melting point: 83°–85° C.

Preparation of compound (5V)

A solution of 57.3 g (0,825 mol) of hydroxylamine hydrochloride in 74 ml water was added at room temperature to 143 g (0.55 mol ) of compound (5.IV) dissolved in 2-methoxy-isopropanol (MIP).

The mixture obtained was cooled to 5° C. whereupon 825 ml of 1M of potassium hydroxide dissolved in 2-methoxy-isopropanol were added. The reaction mixture was stirred overnight at room temperature and then acidified with 60 ml of 5M hydrochloric acid diluted with 1815 ml of water. A sticky precipitate was obtained, which solidified upon stirring. The precipitate was separated by filtration and treated twice with boiling cyclohexane. Upon drying 112 g (yield 73 %) of compound (5.V) were obtained. Melting point: 141° C.

Preparation of compound (5.VII)

96.3 g (0.35 mol) of the oxime compound (5.V), 231 ml of acetic anhydride and 49 ml of pyridine were added to a flask and then the mixture cooled to 0° C. 37 ml of acetyl chloride were then added and the reaction mixture refluxed for one and a half hours after which it was poured onto ice. The resulting precipitate was separated and was treated for 2 h with a boiling mixture of 960 ml of ethanol and 960 ml of concentrated hydrochloric acid. After cooling the precipitate was separated by filtration and stirred for 5 minutes at 100 ° C. in 3100 ml of 2M sodium hydroxide. The precipitate formed on cooling was separated, made alkalifree and dried, yielding 78 g (87 %) of raw (5.VII) with a melting point of 40 ° C. It was purified by dissolving in dichloromethane, removing the residue by filtration and by precipitating again with n-hexane. Yield of purified product: 63 g. Melting point: 145 ° C.

Preparation of compound No. 5

The following ingredients were added to a reaction vessel:

15.4 g (0.06 mol) of compound (5.VII)
36.2 g (0.156 mol) of p-ethyliodobenzene
2.5 g of copper bronze
22.1 g (0.16 mol) of potassium carbonate, and
50 ml of 1,2 dichlorobenzene The reaction mixture was refluxed for 11 h while azeotropically distilling off the water formed in the reaction. After cooling, the reaction mixture was diluted with 200 ml of methanol and the resulting precipitate separated by filtration. The filtrate was evaporated to dryness and the solid product purified by chromatography. Yield: 14.3 g (51%). Melting point: 122 ° C.

According to one preferred embodiment said electrophotographic recording material comprises an electrically conductive support having thereon a photosensitive positive charge generating layer in contiguous relationship (direct contact) with a charge transporting layer, wherein said charge transporting layer contains one or more aromatic amino compounds corresponding to general formula (A) as defined above.

According to another preferred embodiment said electrophotographic recording material comprises an electrically conductive support having thereon a negatively chargeable photoconductive recording layer which contains in an electrically insulating organic polymeric binder material at least one photoconductive n-type pigment substance and at least one p-type photoconductive charge transport substance, wherein (i) at least one of the p-type charge transport substances is an aromatic amino compound corresponding to said general formula (A) as defined above, (ii) the half wave oxidation potentials of the in admixture applied p-type charge transport substances relative to the standard saturated calomel electrode do not differ by more than 0.400 V, (iii) said layer has a thickness in the range of 4 to 40 μm and comprises 8 to 80 % by weight of said n-type pigment substance and 0.01 to 40 % by weight of at least one of said p-type charge transport substance(s) that is (are) molecularly distributed in said electrically insulating organic polymeric binder material that has a volume resistivity of at least $10^{14}$ Ohm-m, and wherein (iv) said recording layer in electrostatically charged state requires for 10 % and 90 % discharge respectively exposures to conductivity increasing electromagnetic radiation that differ by a factor 4.5 or less.

The n-type pigment may be inorganic or organic and may have any colour including white. It is a finely divided substance dispersible in the organic polymeric binder of said photoconductive recording layer.

Optionally the support of said photoconductive recording layer is pre-coated with an adhesive and/or a blocking layer (rectifier layer) reducing or preventing positive hole charge injection from the conductive support into the photoconductive recording layer, and optionally the photoconductive recording layer is overcoated with an outermost protective layer, more details about said layers being given furtheron.

In accordance with a preferred mode of said last mentioned embodiment said photoconductive recording layer has a thickness in the range of 5 to 35 μm and contains 10 to 70% by weight of said n-type pigment material(s) and 1 to 30% by weight of said p-type-transport substance(s).

By the term "n-type" material is understood a material having n-type conductance, which means that the photocurrent ($I_n$) generated in said material when in contact with an illuminated transparent electrode having negative electric polarity is larger than the photocurrent ($I_p$) generated when in contact with a positive illuminated electrode ($I_n/I_p>1$).

By the term "p-type" material is understood a material having p-type conductance, which means that the photocurrent ($I_n$) generated in said material when in contact with an illuminated transparent electrode having positive electric polarity is larger than the photocurrent ($I_p$) generated when in contact with a negative luminated electrode ($I_p/I_n>1$).

Preferred examples of n-type pigments dispersible in the binder of a negatively chargeable recording layer of the electrophotographic recording material according to said last mentioned preferred embodiment are organic pigments from one of the following classes:

- perylimides, e.g.C.I. 71 130 (C.I.=Colour Index) described in DBP 2 237 539,
- polynuclear quinones, e.g. anthanthrones such as C.I. 59 300 described in DBP 2 237 678,
- quinacridones, e.g. C.I. 46 500 described in DBP 2 237 679,
- naphthalene 1,4,5,8-tetracarboxylic acid derived pigments including the perinones, e.g. Orange GR, C.I. 71 105 described in DBP 2 239 923,
- n-type indigo and thioindigo dyes, e.g. Pigment Red 88, C.I. 73 312 described in DBP 2 237 680,
- perylene 3,4,9,10-tetracarboxylic acid derived pigments including condensation products with o-diamines as described e.g. in DAS 2 314 051, and
- n-type polyazo-pigments including bisazo-, trisazo- and tetrakisazo-pigments, e.g. N,N'-bis(4-azobenzenyl )peryl imide.

For the production of a preferred recording material according to the present invention at least one of the aromatic amino compounds according to said general formula (A) is applied in combination with a resin binder to form a charge transporting layer adhering directly to a charge generating layer on an electrically conductive support. Through the resin binder the charge transporting layer obtains sufficient mechanical strength and obtains or retains sufficient capacity to hold an electrostatic charge for copying purposes. Preferably the specific resistivity of the charge transporting layer is not lower than $10^9$ ohm.cm. The resin binders are selected with the aim of obtaining optimal mechanical strength, adherence to the charge generating layer and favourable electrical properties.

Suitable electronically inactive binder resins for use in the charge transporting layer are e.g. cellulose esters, acrylate and methacrylate resins, e.g. cyanoacrylate resign, polyvinyl chloride, copolymers of vinyl chloride, e.g. copolyvinyl/acetate and copolyvinyl/maleic anhydride, polyester resins, e.g. copolyesters of isophthalic acid and terephthalic acid with glycol, aromatic polycarbonate and polyester carbonate resins.

A polyester resin particularly suited for use in combination with aromatic polycarbonate binders is DYNAPOL L 206 (registered trade mark of Dynamit Nobel for a copolyester of terephthalic acid and isophthalic acid with ethylene glycol and neopentyl glycol, the molar ratio of tere- to isophthalic acid being 3/2). Said polyester resin improves the adherence to aluminium that may form a conductive coating on the support of tile recording material.

Suitable aromatic polycarbonates can be prepared by methods such as those described by D. Freitag, U. Grigo, P. R. Miller and W. Nouverting in the Encyclopedia of Polymer Science and Engineering, 2nd ed., Vol. II, pages 648–718, (1988) published by Wiley and Sons Inc., and have one or more repeating units within the scope of the following general formula:

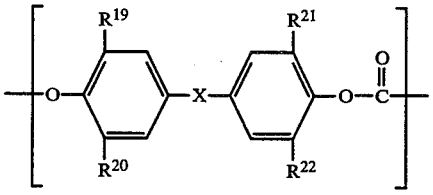

wherein:

X represents S, $SO_2$,

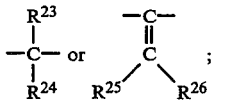

$R^{19}$, $R^{20}$, $R^{21}$, $R^{22}$, $R^{25}$ and $R^{26}$ each represents (same or different) hydrogen, halogen, an alkyl group or an aryl group, and $R^{23}$ and $R^{24}$ each represent (same or different) hydrogen, an alkyl group, an aryl group or together represent the necessary atoms to close a cycloaliphatic ring e.g. cyclohexane ring.

Aromatic polycarbonates having a molecular weight in the range of 10,000 to 200,000 are preferred. Suitable polycarbonates having such a high molecular weight are sold under the registered trade mark MAKROLON of Farbenfabri ken Bayer AG, W-Germany.

MAKROLON CD 2000 (registered trade mark) is a bisphenol A polycarbonate with molecular weight in the range of 12,000 to 25,000 wherein $R^{19}=R^{20}=R^{21}=R^{22}=H$, X is $R^{23}$-C-$R^{24}$ with $R^{23}=R^{24}=CH$ MAKROLON 5700 (registered trade mark) is a bisphenol A polycarbonate with molecular weight in the range of 50,000 to 120,000 wherein $$R^{19} = R^{20} = R^{21} = R^{22} = H,$$

$$X \text{ is } R^{23}-\overset{|}{\underset{|}{C}}-R^{24} \text{ with } R^{23} = R^{24} = CH_2.$$

Bisphenol Z polycarbonatel is an aromatic polycarbonate containing. recurring units wherein $$R^{19} = R^{20} = R^{21} = R^{22} = H, X \text{ is } R^{23}-\overset{|}{\underset{|}{C}}-R^{24},$$

and $R^{23}$ together with $R^{24}$ represents the necessary atoms to close a cyclohexane ring.

Further useful binder resins are silicone resins, polystyrene and copolymers of styrene and maleic anhydride and copolymers of butadiene and styrene.

An example of an electronically active resin binder is poly-N-vinylcarbazole or copolymers of N-vinylcarbazole having a N-vinylcarbazole content of at least 40% by weight.

The ratio wherein the charge-transporting aromatic amino compound(s) and the resin binder are mixed can vary. However, relatively specific limits are imposed, e.g. to avoid crystallization. The content of the aromatic amino compound(s) used according to the present invention in a positive charge transport layer is preferably in the range of 20 to 70% by weight with respect to the total weight of said layer. The thickness of the charge transport layer is in the range of 5 to 50 μm, preferably in the range of 5 to 30 pm.

The presence of one or more spectral sensitizing agents can have an advantageous effect on the charge transport. In that connection reference is made to the methine dyes and xanthene dyes described in U.S. Pat. No. 3,832,171. Preferably these dyes are used in an amount not substantially reducing the transparency in the visible light region (420–750 nm) of the charge transporting layer so that the charge generating layer still can receive a substantial amount of the exposure light when exposed through the charge transporting layer.

The charge transporting layer may contain compounds substituted with electron-acceptor groups forming an intermolecular charge transfer complex, i.e. donor-acceptor complex wherein the hydrazone compound represents an electron donating compound. Useful compounds having electron-accepting groups are nitrocellulose and aromatic nitro-compounds such as nitrated fluorenone -9 derivatives, nitrated 9-dicyanomethyl and fluorenone derivatives, nitrated naphthalenes and nitrated naphthalic acid anhydrides or imide derivatives. The optimum concentration range of said derivatives is such that the molar donor/acceptor ratio is 10: 1 to 1,000: 1 and vice versa.

Compounds acting as stabilising agents against deterioration by ultra-violet radiation, so-called UV-stabilizers, may also be incorporated in said charge transport layer. Examples of UV-stabilizers are benztriazoles.

For controlling the viscosity of the coating compositions and controlling their optical clarity silicone oils may be added to the charge transport layer.

The charge transport layer used in the recording material according to the present invention possesses the property of offering a high charge transport capacity coupled with a low dark discharge. While with the common single layer photoconductive systems an increase in photosensitivity is coupled with an increase in the dark current and fatigue such is not the case in the present double layer arrangement wherein the functions of charge generation and charge transport are separated and a photosensitive charge generating layer is arranged in contiguous relationship to a charge transporting layer.

As charge generating compounds for use in a recording material according to the present invention any of the organic pigment dyes belonging to one of the classes a) to n) mentioned hereinbefore may be used. Further examples of pigment dyes useful for photogenerating positive charge carriers are disclosed in U.S. Pat. No. 4,365,014.

Inorganic substances suited for photogenerating positive charges in a recording material according to the present invention are e.g. amorphous selenium and selenium alloys e.g. selenium-tellurium, selenium-tellurium-arsenic and selenium-arsenic and inorganic photoconductive crystalline compounds such as cadmium sulphoselenide, cadmiumselenide, cadmium sulphide and mixtures thereof as disclosed in U.S. Pat. No. 4,140,529.

Said photoconductive substances functioning as charge generating compounds may be applied to a support with or without a binding agent. For example, they are coated by vacuum-deposition without binder as described e.g. in U.S. Pat. Nos. 3,972,717 and 3,973,959. When dissolvable in an organic solvent the photoconductive substances may likewise be coated using a wet coating technique known in the art whereupon the solvent is evaporated to form a solid layer. When used in combination with a binding agent or agents at least the binding agent(s) should be soluble in the coating solution and the charge generating compound dissolved or dispersed therein. The binding agent(s) may be the same as the one(s) used in the charge transport layer which normally provides best adhering contact, In some cases it may be advantageous to use in one or both of said layers a plasticizing agent, e.g. halogenated paraffin, polybiphenyl chloride, dimethylnaphthalene or dibutyl phthalate, The thickness of the charge generating layer is preferably not more than 10 μm, more preferably not more than 5 μm.

In the recording materials of the present invention an adhesive layer or barrier layer may be present between the charge generating layer and the support or the charge transport layer and the support. Useful for that purpose are e.g. a polyamide layer, nitrocellulose layer, hydrolysed silane layer, or aluminium oxide layer acting as blocking layer preventing positive or negative charge injection from the support side. The thickness of said barrier layer is preferably not more than 1 micron.

The conductive support may be made of any suitable conductive material. Typical conductors include aluminum, steel, brass and paper and resin materials incorporating or coated with conductivity enhancing substances, e.g. vacuum-deposited metal, dispersed carbon black, graphite and conductive monomeric salts or a conductive polymer, e.g. a polymer containing quaternized nitrogen atoms as in Calgon Conductive polymer 261 (trade mark of Calgon Corporation, Inc., Pittsburgh, Pa., U.S.A.) described in U.S. Pat. No. 3,832,171.

The support may be in the form of a foil, web or be part of a drum.

An electrophotographic recording process according to the present invention comprises the steps of:

(1) overall electrostatically charging, e.g. with corona-device, the photoconductive layer containing at least one aromatic amino compound according to the above defined general formula (A), (2) image-wise photo-exposing said layer thereby obtaining a latent electrostatic image, that may be toner-developed.

When applying a bilayer-system electrophotographic recording material including on an electrically conductive support a photosensitive charge generating layer in contiguous relationship with a charge transporting layer that contains one or more aromatic amino compounds corresponding to the general formula (A) as defined above, the photo-exposure of the charge generating layer proceeds preferably through the charge transporting layer but may be direct if the charge generating layer is uppermost or may proceed likewise through the conductive support if the latter is transparent enough to the exposure light.

The development of the latent electrostatic image commonly occurs preferably with finely divided electrostatically attractable material, called toner particles that are attracted by coulomb force to the electrostatic charge pattern. The toner development is a dry or liquid toner development known to those skilled in the art.

In positive-positive development toner particles deposit on those areas of the charge carrying surface which are in positive-positive relation to the original image. In reversal development, toner particles migrate and deposit on the recording surface areas which are in negative-positive image value relation to the original. In the latter case the areas discharged by photo-exposure obtain by induction through a properly biased developing electrode a charge of opposite charge sign with respect to the charge sign of the toner particles so that the toner becomes deposited in the photo-exposed areas that were discharged in the imagewise exposure (ref.: R. M. Schaffert "Electrophotography"—The Focal Press—London, N.Y., enlarged and revised edition 1975, p. 50–51 and T. P. Maclean "Electronic Imaging" Academic Press—London, 1979, p. 231).

According to a particular embodiment electrostatic charging, e.g. by corona, and the imagewise photo-exposure proceed simultaneously.

Residual charge after toner development may be dissipated before starting a next copying cycle by overall exposure and/or alternating current corona treatment.

Recording materials according to the present invention depending on the spectral sensitivity of the charge generating layer may be used in combination with all kinds of photon-radiation, e.g. light of the visible spectrum, infra-red light, near ultra-violet light and likewise X-rays when electron-positive hole pairs can be formed by said radiation in the charge generating layer. Thus, they can be used in combination with incandescent lamps, fluorescent lamps, laser light sources or light emitting diodes by proper choice of the spectral sensitivity of the charge generating substance or mixtures thereof.

The toner image obtained may be fixed onto the recording material or may be transferred to a receptor material to form thereon after fixing the final visible image.

A recording material according to the present invention showing a particularly low fatigue effect can be used in recording apparatus operating with rapidly following copying cycles including the sequential steps of overall charging, imagewise exposing, toner development and toner transfer to a receptor element.

According to another embodiment the aromatic amino compounds of the general formula (A) having positive charge transport capacity i.e. being hole transporting materials, are used in the production up of an electroluminescent cell as described e.g. in J. Appl. Phys. 65, May 1, 1989, p. 3610–3616 and published EP-A 0 468 437. Said electroluminescent cell consists basically of an assemblage of a hole-transporting layer (here containing at least one of said aromatic amino compounds) and a luminescent electron-transporting layer between contacting electrodes having charge injecting properties.

The following examples further illustrate the present invention. All parts, ratios and percentages are by weight unless otherwise stated.

The evaluations of electrophotographic properties determined on the recording materials of the following examples relate to the performance of the recording materials in an electrophotographic process with a reusable photoreceptor. The measurements of the performance characteristics were carried out as follows:

The photoconductive recording sheet material was mounted with its conductive backing on an aluminium drum which was earthed and rotated at a circumferential speed of 10 cm/s. The recording material was sequentially charged with a negative scorotron at a voltage of −5.7 kV operating with a grid voltage of −600 V. Subsequently the recording material was exposed (simulating image-wise exposure) with a light dose of monochromatic light obtained from a monochromator positioned at the circumference of the drum at an angle of 45° with respect to the corona source. The photo-exposure lasted 200 ms. Thereupon, the exposed recording material passed an electrometer probe positioned at an angle of 180° with respect to the corona source. After effecting an overall post-exposure with a halogen lamp producing 360 mJ/m2 positioned at an angle of 270° with respect to the corona source a new copying cycle started. Each measurement relates to 80 copying cycles in which the photoconductor is exposed to the unmoderated light source intensity for the first 5 cycles, then sequentially to the light source intensity moderated by 14 grey filters of optical densities between 0.21 and 2.52 each for 5 cycles and finally to zero light intensity for the last 5 cycles.

The electro-optical results quoted in the EXAMPLES hereinafter refer to charging level at zero light intensity (CL) and to discharge at a light intensity corresponding to the light source intensity moderated by a grey filter with an optical density of 1.0 to a residual potential RP except in the case of 780 nm exposure in which the grey filter has an optical density of 1.5.

The % discharge is:

$$\frac{(CL - RP)}{CL} \times 100$$

For a given corona voltage, corona current, separating distance of the corona wires to recording surface and drum circumferential speed the charging level CL is only dependent upon the thickness of the charge transport layer and its specific resistivity. In practice CL expressed in volts should be preferably >30 d, where d is the thickness in μm of the charge transport layer.

Differential scanning calorimetry was used both to determine the glass transition temperature of the charge transport layers and to investigate the solubility of the charge transport substances in the polycarbonate binding resin used. In the event of incomplete solubility of the charge transport substance in the binding resin a melt peak is observed in the scan, which corresponds to the melting point of the charge transport substance. The latent heat of melting/g of this peak is a measure of the insolubility of the charge transport substance.

The half-wave oxidation potential measurements were carried out using a polarograph with rotating (500 rpm) disc platinum electrode and standard saturated calomel electrode at room temperature (20° C. using a product concentration of 10 mole and an electrolyte (tetrabutylammonium perchlorate) concentration of 0.1 mole in spectroscopic grade acetonitrile. Ferrocene was used as a reference substance having a half-wave oxidation potential of +0.430 V.

All ratios and percentages mentioned in the Examples are by weight.

EXAMPLES 1 to 7

A photoconductor sheet was produced by first doctor blade coating a 100 μm thick polyester film precoated with a vacuum-deposited conductive layer of aluminium with a 1% solution of γ-aminopropyltriethoxy silane in aqueous methanol. After solvent evaporation and curing at 100 ° C. for 30 minutes, the thus obtained adhesion/blocking layer was doctor blade coated with a dispersion of charge generating pigment to thickness of 0.6 micron.

Said dispersion was prepared by mixing 5 g of 4,10-dibromo-anthanthrone, 0.75 g of aromatic polycarbonate MAKROLON CD 2000 (registered trade mark) and 29.58 g of dichloromethane for 40 hours in a ball mill. Subsequently a solution of 4.25 g of MAKROLON CD 2000 (registered trade mark) in 40.75 g of dichloromethane was added to the dispersion to produce the composition and viscosity for coating.

After drying for 15 minutes at 50° C., this layer was coated with a filtered solution of charge transporting material and MAKROLON 5700 (registered trade mark) in dichloromethane at a solids content of 12% by wt. This layer was then dried at 50 ° C. for 16 hours.

The characteristics of the thus obtained photoconductive recording material were determined with a light dose of 10 mJ/m2 of 540 nm light as described above.

The electro-optical characteristics of the corresponding photoconductors together with the aromatic amino compound used as the p-CTM, the p-CTM concentration and some differential scanning calorimetry results and glass transition temperatures (Tg) obtained with the change transport layers are summarized in Table 2.

TABLE 2

| Ex. no. | Charge transport comp. | Charge transport comp. conc. [wt %] | Thickness of CTL [μm] | CL [V] | Wavelength λ [nm] | Exposure It [mJ/m²] | RP [V] | % Discharge | Charge transport layer characteristics: Tg [°C.] | Melt peak [°C.] | Heat of melting [J/g] |
|---|---|---|---|---|---|---|---|---|---|---|---|
| 1 | 1 | 50 | 13.4 | −493 | 540 | 10 | −43 | 91.3 | 82.5 | 165.5 | 3.02 |
| 2 | 2 | 50 | 13.4 | −507 | 540 | 10 | −82 | 83.8 | 76.6 | 173.4 | 8.12 |
| 3 | 3 | 50 | 12.4 | −540 | 540 | 10 | −145 | 73.1 | 72.7 | | |
| 4 | 5 | 40 | 10.4 | −561 | 540 | 10 | −265 | 52.8 | 86.1 | | |
| 5 | 7 | 50 | 12.4 | −617 | 540 | 10 | −510 | 17.3 | 63.5 | | |
| 6 | 8 | 50 | 11.4 | −633 | 540 | 10 | −512 | 19.1 | 98.3 | 171.6 | 0.18 |
| 7 | 9 | 50 | 11.4 | −639 | 540 | 10 | −548 | 14.2 | | | |

EXAMPLES 8 to 14

The photoconductive recording materials of Examples 8 to 14 were produced as for Examples 1 to 7 except that the χ-form of metal-free phthalocyanine was used as the charge generating material instead of 4,10dibromoanthanthrone and the charge generating material dispersion was mixed for 16 h instead of 40 h.

The characteristics of the thus obtained photoconductive recording material were determined as described above in the photo-exposure step a light dose of 20 mJ/m2 of 660 nm or 780 nm light ($I_{660}t$ or $I_{780}t$) was used.

The charge transport compounds used, their concentration in the charge transport layer, the thickness in pm of the charge transport layer (CTL) and the electro-optical characteristics of the corresponding photoconductive recording materials are summarized in Table 3.

TABLE 3

| Ex. no. | Charge transport comp. | Charge transport comp. conc. [wt %] | Thickness of CTL [μm] | CL [V] | Wavelength λ [nm] | Exposure It [mJ/m²] | RP [V] | % Discharge |
|---|---|---|---|---|---|---|---|---|
| 8 | 1 | 50 | 12.4 | −541 | 780 | 20 | −100 | 81.5 |
| 9 | 2 | 50 | 12.4 | −558 | 780 | 20 | −109 | 80.5 |
| 10 | 3 | 50 | 12.4 | −553 | 780 | 20 | −81 | 85.4 |
| 11 | 5 | 40 | 11.4 | −400 | 780 | 20 | −102 | 74.5 |
| 12 | 7 | 50 | 12.4 | −567 | 780 | 20 | −390 | 31.2 |
| 13 | 8 | 50 | 12.4 | −497 | 660 | 20 | −370 | 25.6 |
| 14 | 9 | 50 | 11.4 | −560 | 660 | 20 | −356 | 36.4 |

EXAMPLES 15 to 21

The photoconductive recording materials of Examples 15 to 21 were produced as for Examples 1 to 7. except that the adhesion/blocking layer was produced by coating the aluminium-coated polyester film with a 3% solution of γ-aminopropyltriethoxysilane in aqueous methanol instead of a 1% solution, the m-form of metal-free triazatetrabenzoporphine (already described in unpublished EP-A 89121024.7) was applied at a concentration of 40% in the charge generating layer instead of 4,10-dibromoanthanthrone at a concentration of 50% by weight and that the charge generating material dispersion was mixed for 16 h instead of 40 h before coating.

The characteristics of the thus obtained photoconductive recording material were determined as described above but in the photo-exposure a light dose of 20 mJ/m² of 650 nm or 780 nm light ($I_{650}t$ or $I_{780}t$) was used.

The charge transport compounds used, their concentration in the charge transport layer, the thickness in μm of the charge transport layer (CTL) and the electro-optical characteristics of the corresponding photoconductive recording materials are summarized in Table 4.

TABLE 4

| Ex. no. | Charge transport comp. | Charge transport comp. conc. [wt %] | Thickness of CTL [μm] | CL [V] | Wavelength λ [nm] | Exposure It [mJ/m²] | RP [V] | % Discharge |
|---|---|---|---|---|---|---|---|---|
| 15 | 1 | 50 | 12.4 | −403 | 650 | 20 | −135 | 66.5 |
| 16 | 2 | 50 | 13.4 | −417 | 650 | 20 | −151 | 63.8 |
| 18 | 3 | 50 | 11.4 | −588 | 780 | 20 | −143 | 63.1 |
| 21 | 5 | 40 | 11.4 | −281 | 780 | 20 | −118 | 58.0 |
| 17 | 7 | 50 | 12.4 | −539 | 780 | 20 | −478 | 11.3 |
| 19 | 8 | 50 | 12.4 | −503 | 780 | 20 | −412 | 18.1 |
| 20 | 9 | 50 | 11.4 | −523 | 780 | 20 | −412 | 21.2 |

We claim:

1. An electrophotographic recording material which comprises an electrically conductive support having thereon a photoconductive layer, containing at least one aromatic amino compound having positive charge transport capacity (p-CTM compound), characterized in that said compound corresponds to the following general formula (A):

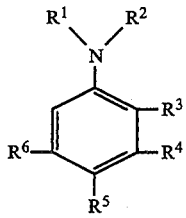

wherein:

each of $R^1$ and $R^2$ independently represents an unsubstituted or substituted aryl group, or a heterocyclic group;

each of $R^3$ and $R^5$ independently represents hydrogen, an alkyl group, an aralkyl group, halogen or an aryl group;

each of $R^4$ and $R^6$ independently represents an aryl or a heterocyclic group including said groups in substituted from.

2. An electrophotographic recording material according to claim 1, wherein said p-CTM compound according to said general formula (A) is present in a charge transporting layer in direct contact with a photosensitive positive charge generating layer.

3. An electrophotographic recording material according to claim 2, wherein said aromatic amino compound is applied in combination with a resin binder to form a charge transporting layer adhering directly to said positive charge generating layer with one of the two layers being itself carried by said electrically conductive support.

4. An electrophotographic recording material according to claim 3, wherein the resin binder is selected from the group consisting of a cellulose ester, acrylate or methacrylate resin, polyvinyl chloride, copolymer of vinyl chloride, polyester resin, an aromatic polycarbonate resin, an aromatic polyester carbonate resin, silicone resin, polystyrene, a copolymer of styrene and maleic anhydride, a copolymer of butadiene and styrene, poly-N-vinylcarbazole and a copolymer of N-vinylcarbazole having a N-vinylcarbazole content of at least 40% by weight.

5. An electrophotographic recording material according to claim 2, wherein the content of said aromatic amino compound in the charge transporting layer is in the range of 20 to 70% by weight with respect to the total weight of said layer.

6. An electrophotographic recording material according to claim 1, wherein said conductive support stands in contact with a negatively chargeable photoconductive recording layer which contains in an electrically insulating organic polymeric binder material at least one photoconductive n-type pigment substance and a plurality of p-type photoconductive charge transport substance, wherein (i) at least one of said p-type charge transport substances is a compound corresponding to said general formula (A), (ii) the half wave oxidation potentials of the applied p-type charge transport substances relative to the standard saturated calomel electrode do not differ by more than 0.400 V, (iii) said layer has a thickness in the range of 4 to 40/μm and comprises 8 to 80% by weight of said n-type pigment substance and 0.01 to 40 % by weight of said p-type charge transport substances that are molecularly distributed in an electrically insulating organic polymeric binder material that has a volume resistivity of at least $10^{14}$ Ohm-m, and (iv) said recording layer in electrostatically charged state requires for 10% and 90% discharge respectively exposures to conductivity increasing electromagnetic radiation that differ by a factor 4.5 or less.

7. An electrophotographic recording material according to claim 6, wherein said recording layer has a thickness in the range of 5 to 35 μm and contains 10 to 70% by weight of said n-type pigment substance and 1 to 30% by weight of said compound according to said general formula (A).

8. An electrophotographic recording material according to claim 6, wherein at least one of said n-type pigment substances is selected from the group consisting of:

a) perylimides,
b) polynuclear quinones,
c) quinacridones,
d) naphthalene 1,4,5,8 tetracarboxylic acid derived pigments,
e) phthalocyanines and naphthalocyanines,
g) benzothioxanthene-derivatives,
h) perylene 3,4,9,10-tetracarboxylic acid derived pigments,
i) polyazo pigments,
j) squarilium dyes,
k) polymethine dyes,
l) dyes containing quinazoline groups,
m) triarylmethane dyes, and
n) dyes containing 1,5-diamino-anthraquinone groups.

9. An electrophotographic recording material according to any of one claims 1 to 5, wherein said aromatic amino compound has a melting point of at least 100° C.

* * * * *